United States Patent [19]

Wycech

[11] Patent Number: 4,964,514

[45] Date of Patent: Oct. 23, 1990

[54] CUSTOMIZED PLASTIC TRAY AND METHOD OF MAKING SAME

[76] Inventor: Joseph S. Wycech, 1505 Huntington, Grosse Pointe Woods, Mich. 48236

[21] Appl. No.: 301,554

[22] Filed: Jan. 26, 1989

[51] Int. Cl.[5] ..... B65D 25/20

[52] U.S. Cl. ..... 206/564; 206/523; 206/587; 220/461

[58] Field of Search ..... 206/523, 521, 315.11, 206/373, 557, 562, 563, 564, 587; 217/27; 220/21, 461

[56] References Cited

U.S. PATENT DOCUMENTS

| | | | |
|---|---|---|---|
| 2,861,682 | 11/1958 | Hatcher | 206/564 |
| 3,122,265 | 2/1964 | Innis | 206/564 |
| 3,181,693 | 5/1965 | Freistat | 206/523 |
| 3,777,882 | 12/1973 | McIntyre | 206/523 |
| 4,433,781 | 2/1984 | Hummel | 206/523 |
| 4,640,418 | 2/1987 | Lowry | 206/523 |
| 4,657,138 | 4/1987 | Watson | 206/564 |
| 4,711,348 | 12/1987 | Schluger | 206/523 |

FOREIGN PATENT DOCUMENTS

| | | | |
|---|---|---|---|
| 0966623 | 8/1964 | United Kingdom | 206/523 |

*Primary Examiner*—Jimmy G. Foster
*Attorney, Agent, or Firm*—Dykema Gossett

[57] ABSTRACT

A method and apparatus is disclosed that enables a consumer to store a wide variety of items in a customized storage unit. The customized storage unit consists of a plastic storage tray that has a pattern of item-receiving compartments formed therein that will correspond exactly to the shapes of items that the consumer wishes to store. The pattern is developed first reading the profiles of the items the consumer wishes to store into a computer graphics unit and arranging these stored profiles into an optimized pattern. This pattern is next sent to a computer-aided manufacturing unit that is connected to a hot wire cutter that cuts the desired pattern into a sheet of structural foam. The cut-out cores of the profiles of the items to be stored are next removed from the structural foam sheet leaving cavities within the sheet. The structural foam sheet is next placed on the lower platen of a vacuum form machine, and the cut-out cores are attached to the upper platen. A sheet of thermoplastic is heated so that it is malleable and is placed upon the structural foam sheet. A vacuum is applied to the lower platen and the upper platen is next brought downwardly into contact with the thermoplastic sheet and pushes the plastic downwardly into the cavity formed in the structural foam sheet. The upper platen is next brought back upwardly away from the thermoplastic sheet, and the thermoplastic sheet and its associated structural foam sheet are allowed to cool. When forming a compartment for a thinner item, it is not necessary to utilize the cut-out cores. The resulting product is a sturdy plastic storage tray that has an upper sheet of plastic and a lower backing unit of structural foam.

1 Claim, 2 Drawing Sheets

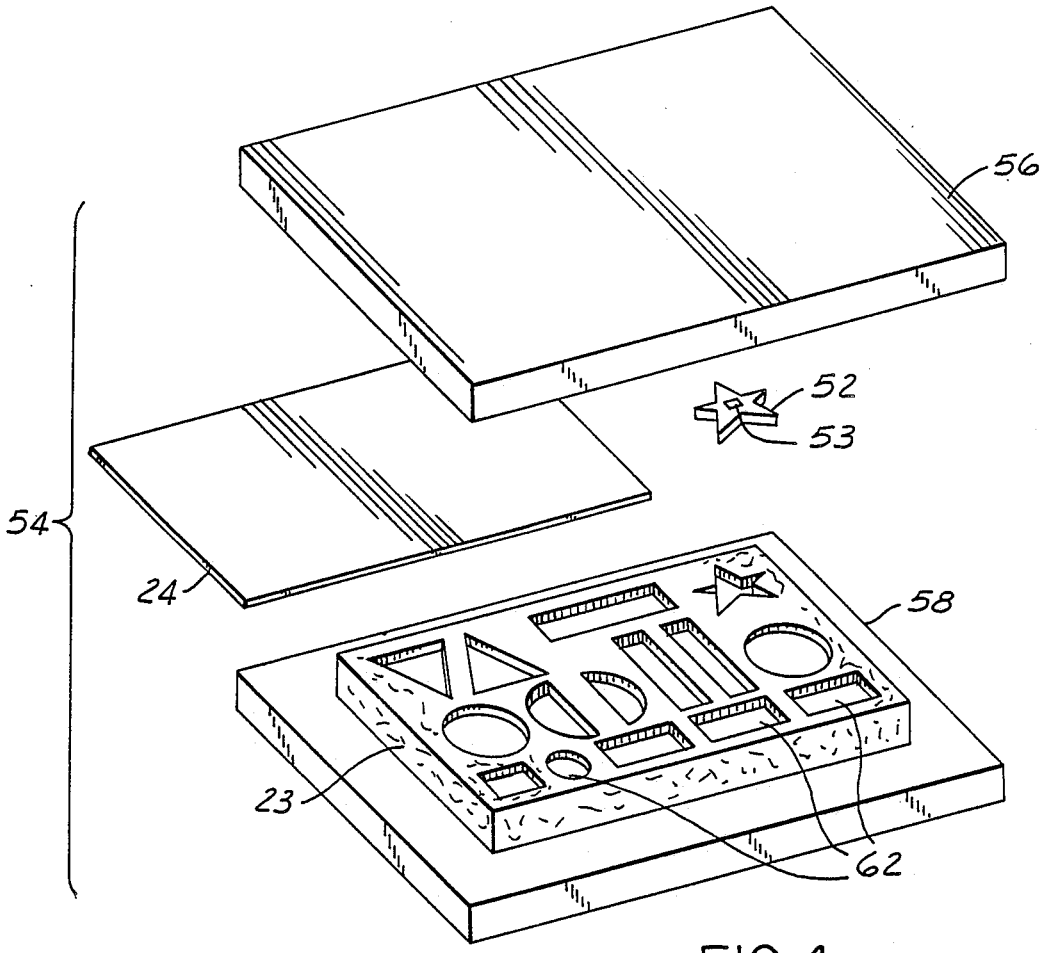
FIG.4
FIG.5
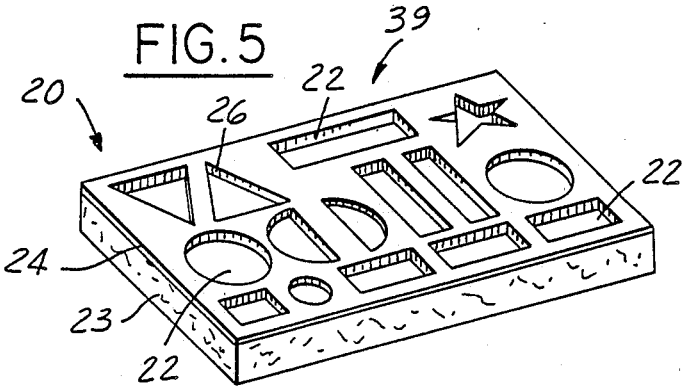

CUSTOMIZED PLASTIC TRAY AND METHOD OF MAKING SAME

BACKGROUND OF THE INVENTION

This invention in general relates to a storage tray that a consumer can custom-make to correspond to the items that he may have to store.

Consumers typically have a large number of household goods that are difficult to store. These household goods would include hand tools, flatware, Christmas ornaments, fishing lures, and other miscellaneous parts. As an example, Christmas ornaments are usually stored in a bag or box without having partitions or specific compartments for each ornament. The ornaments will usually break over a period of time or else will be lost, and as a consequence, ornaments are difficult to find from year-to-year. Also, the way they are stored is not usually a very efficient use of space. These problems would also hold true when storing such items as a group of screwdrivers in a drawer or even for storing screws or other small items that need to be retained in a compartment rather than being loose.

Athough several types of storage units are available on the market, none can be individually tailored to a consumer's specific needs. That is, an off-the-shelf storage unit may be available that would have a series of small compartments for storage of various items; however, these storage spaces would not necessarily conform to the exact spaces needed by a consumer for a particular storage application. These off-the-shelf storage units would not have a storage space to conform to the shape of any unusually-shaped items that a consumer may have a need to store. And, in addition, these off-the-shelf items would not conform to the size of a consumer's drawer or other container.

For these reasons, it is an object of the present invention to create a storage unit that can be customized to conform to the exact storage needs of a consumer.

It is further an object of the present invention to create a storage unit that will make the most efficient use of the volume of storage space that is being utilized.

It is moreover an object of the present invention to achieve the above goals with a storage unit that is relatively simple and easy to manufacture.

SUMMARY OF THE INVENTION

In accordance with the present invention, a storage tray unit is disclosed that is to be received within a drawer, workbench, tool chest or other cabinet. The storage tray is sized so as to conform to the dimensions of the specific drawer or other container. The storage unit consists of an upper portion that is a thermoplastic sheet with receiving compartments formed therein to receive the various items to be stored. This thermoplastic sheet is mounted above a sheet of Styrofoam TM, or other structural foam, that has cavities extending over its entire length and corresponding to the various receiving compartments in the plastic sheet. The cavities and storage compartments are arranged in a pattern that would most efficiently utilize the storage space, and the cavities and storage compartments are shaped so as to correspond exactly to the needs of the consumer for the specific items he wishes to store.

The unique method of assembling the plastic storage tray consists of first picking a drawer or other compartment that will hold the plastic tray and measuring the width, length and height of the drawer in order to determine the size of tray that may be utilized. It may be preferable to size the tray slightly smaller than the dimensions of the drawer in order to make it fit more easily into the drawer. The next step is for the consumer to select the items or parts that will be stored within the tray. These parts may be of any shape and may have very irregular shapes, such as a star-shaped Christmas ornament. The consumer would then lay out these items individually on a piecce of paper, take a pencil or pen and outline the outermost dimensions of the item onto a piece of paper. For instance, if the consumer were outlining a spherical item, he would hold the pencil perpendicular to an equatorial circumference of the sphere and trace this circumference onto the paper. The customer may use a sheet of paper sized to conform to the size of the drawer or container. This profile pattern is next traced and read into a computer graphics system with the use of a computer light reader pen. A fabricator merely traces the light reader pen around the outline, or outlines, and the shape of this profile will be automatically entered into the computer grahics unit's memory. The software and apparatus necessary for performing this function are well-known and widely available on the market. The fabricator then proceeds on, tracing the shapes of the various items to be stored and entering them into the computer graphics memory.

Once all the items to be stored have been entered into the computer graphics memory, the consumer will modify the positions of the various items so as to use the most efficient use of the storage space by maximizing the number of items that can be stored in a specific tray. Basically, this would require a computer software program that will allow easy positioning of the entered profiles of the various items to be stored. The fabricator continues changing the position of these profiles until they are all received within the dimensions of the intended plastic tray. Computer software programs for moving the location of various items are well-known and currently widely available on the market. Once this final outline of the tray is determined, the tray pattern is entered or saved into the computer memory.

Next, the actual manfacture of the tray begins. The first step is to obtain a sheet of Styrofoam TM, or other structural foam, that is of the desired dimensions for the final tray. Alternatively, one could start with a sheet of Styrofoam TM that is larger than the final desired dimensions and cut it down to size at a later step. A computer-aided manufacturing unit with a robot-like arm is connected to a hot wire cutter that is to be used to cut the pattern shapes into the Styrofoam TM sheet. Some means is then utilized to transfer the stored pattern of shapes that are within the computer graphics memory to the computer-aided manufacturing unit. This could be done for instance by transferring the data from the computer graphics unit onto a computer disk and utilizing this computer disk to control the computer-aided. manufacturing unit. However, any way of communicating the data between the computer graphics unit and the computer-aided manufacturing unit could be used.

The robot arm of the computer-aided manufacturing unit then moves the hot wire cutter on the Styrofoam TM sheet to cut the shapes of the items to be stored in the Styrofoam TM sheet. After all the interior pieces are cut out, the perimeter of the Styrofoam TM could then be cut to get the final shape and dimensions of the tray.

Once all the interior pieces have been cut out of the Styrofoam TM sheet, the cut-out parts or cores are removed from the sheet, and the remaining sheet with the cavities is transferred to a vacuum form machine. The vacuum form machine is illustrated in a simplified form and is actually a very complex machine. The cut-out parts are attached in some way to the upper platen of the vacuum form machine, for instance by a Velcro TM strip or a light vacuum. The Styrofoam TM sheet is place on the lower platen of the vacuum form machine, and the upper platen is brought downwardly to ensure that the cut-out parts are aligned with the cavities on the Styrofoam TM sheet.

Next, a piece of thermoplastic is heated until it is malleable. It is then placed over the main Styrofoam TM sheet, and the upper platen is brought downwardly so that the cut-out parts make contact with the thermoplastic sheet and force it downwardly into the cavities, thereby giving the final configuration to the package tray. A vacuum is applied to the lower platen to assist in drawing the plastic into the cavity. The upper platen is returned upwardly, and the cut-out parts remain attached to it. The tray itself is located on the lower platen and consists of the thermoplastic sheet that has been molded to the specific pattern and attached to the main Styrofoam TM sheet. Once the plastic material cools, it can be removed and trimmed into its final configuration.

This invention is unique since the container can have any desired configuration of item receiving spaces, and in addition, the outer boundaries of the container can be of any shape. The computer-aided manufacturing cut-out could cut the Styrofoam TM sheet so that the outer dimensions of the final plastic tray are round, oblique or whatever shape is desired to best meet the consumer's needs.

With this technology, no special tools are required to create any shape that may be required. It will be convenient for the consumer to house and store any household items that may otherwise be lost and cannot be properly stored.

BRIEF DESCRIPTION OF THE DRAWINGS

FIG. 4 illustrates the platen of a vacuum form machine that is utilized to form the shape of the plastic tray of the present invention.

FIG. 5 is a perspective view showing the finalized plastic stroage tray of the present invention.

DETAILED DESCRIPTION OF THE INVENTION

Figure 1:
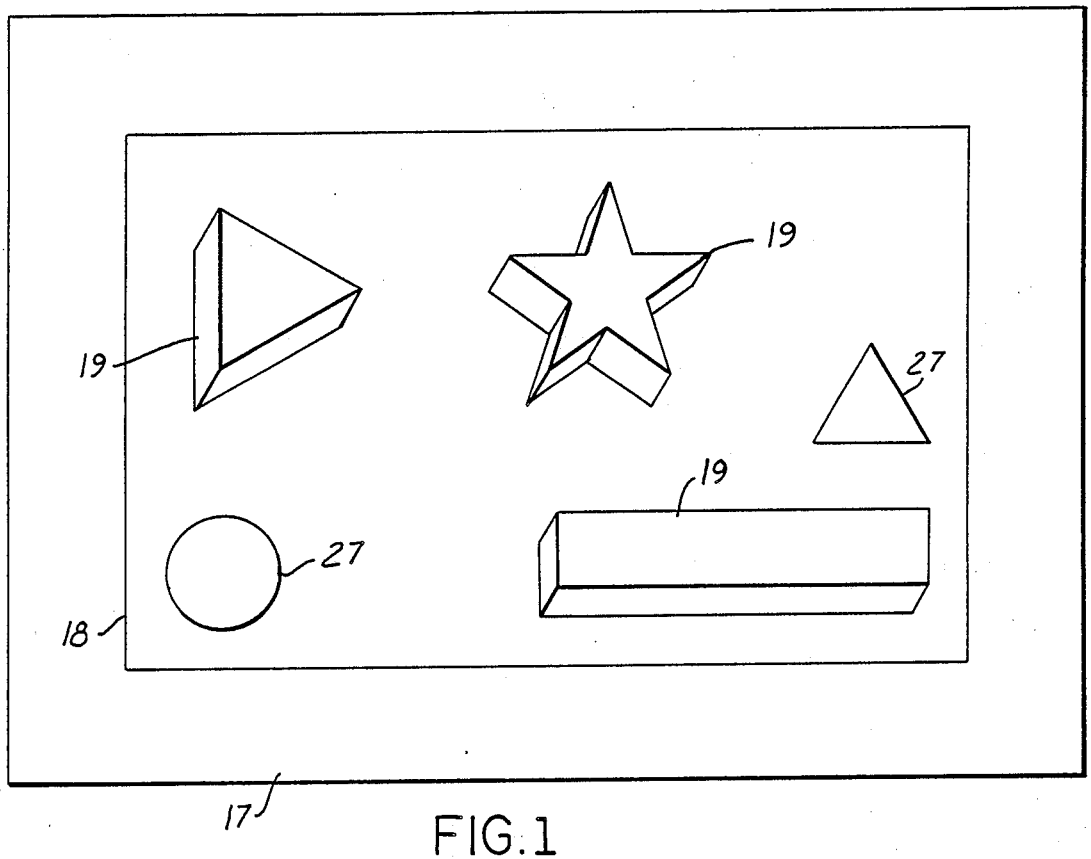
FIG. 1 illustrates loose itmes arranged on a piece of paper that is of a selected size in accordance with the method of the present invention.

A plastic storage tray as disclosed by the present invention can be best understood from FIG. 5. FIG. 5 shows plastic tray 20 with receiving compartments 22 formed in a pattern on the surface of a thermal sheet of plastic 24. The plastic is mounted above a sheet of Styrofoam TM 23, or other structural foam, that provides a rigid backing to the thin plastic sheet. As can been seen, receiving compartments 22 are molded into the plastic, and there is a plastic bottom 26 integral with plastic sheet 24 in each of receiving compartments 22. It is to be understood that another structural material could be used for member 23 rather than foam. The plastic sheet 24 could also be molded onto the sides of foam sheet 23.

The plastic storage tray 20 is intended to be received in a drawer or other storage compartment; however, it may also be used with a cardboard box or the like. Several of these plastic trays 20 may be stacked upon themselved if the drawer or other container is of sufficient height to receive several of the sheets. Additionally, as long as plastic tray 20 is being used with a drawer, it is not necessary that receiving or storage compartments 22 have a bottom 26 such as illustrated in FIG. 5. In such applications, the use of plastic sheet 24 may be necessary. The dimensions of plastic tray 20 are customized so that they correspond to the dimensions of the drawer or container that plastic tray 20 is to be received in. In addition, the shapes of storage compartments 22 are selected to correspond to the exact profiles of the items that a consumer may wish to store in plastic tray 20. The thermosplastic used for sheet 24 may be polystyrene, ABS or any other type of well-known plastic.

The method manufacturing plastic tray 20 will now be described with reference to FIGS. 1,2,3 and 4. The consumer would first select a group of items that are to be stored together. This may be, for instance, a group of Christmas ornaments or any other common set of objects. The dimensions of the drawer or other container that is to receive tha plastic tray would next be measured. From this, the consumer can define a space that is to be utilized and trace that space on a sheet of paper 17 to define boundaries 18 as shown in FIG. 1. The consumer would then trace a profile of the various items 19 onto this sheet of paper 17 within the boundaries 18. This outline 27 should be such that it traces the outermost dimensions of the profile of the item to be stored.

Figure 2:
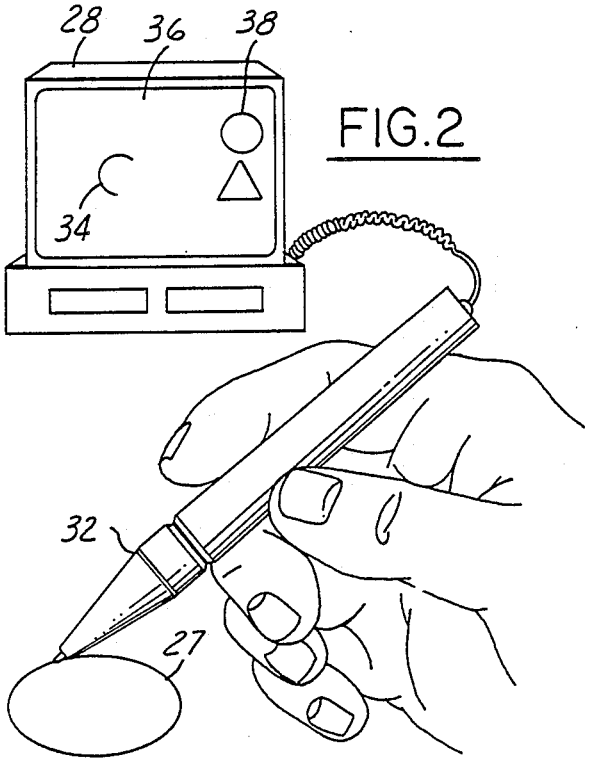
FIG. 2 illustrates a computer graphics screen and light reader pen performing one of the steps of the method of the present invention.
Figure 3:
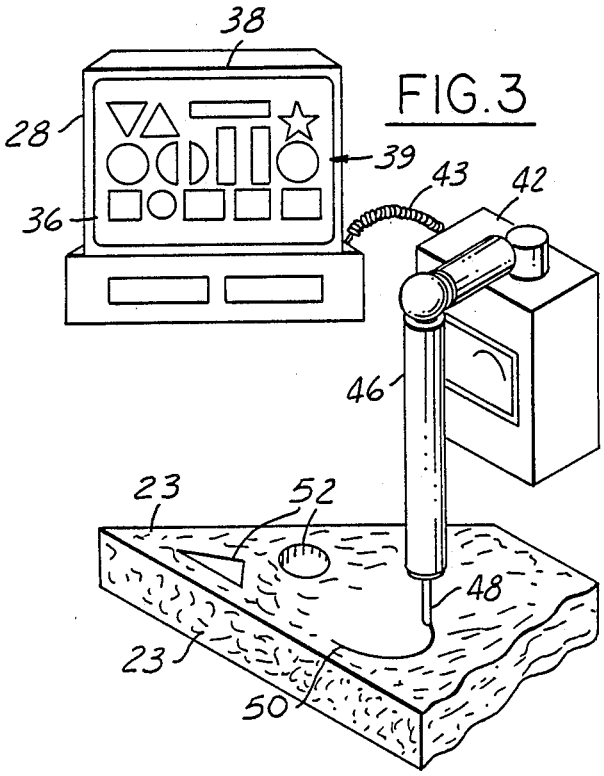
FIG. 3 illustrates the computer graphics screen and a computer-aided manufacturing unit performing a later step in the method of the present invention.

Outline 27 is next entered into a computer graphics unit 28 by tracing outline 27 with an image scanner such as a computer light reader pen 32. As shown in FIG. 2, an outline 34 is being entered onto computer graphic screen 36. Outline 38 that have already been entered into computer graphic unit 28 can be seen displayed on computer screen 36 in FIG. 2 also. For purposes of entering this data, any type of computer graphic unit and image scanner may be utilized. The technology for performing these operations is well known and widely available. Once all of outlines 38 have been individually entered into computer graphic unit 28, the operator may utilize a computer software program that allows him to move outline 38 about screen 36, that is, a commercial software Computer-Aided Design (CAD) program that allows the movement of computer graphic images upon a screen. This program could supplement or replace the step of manually arranging the items within boundaries. The operator utilizes this software to arrive at an array of outlines 38 that form a pattern 39 that optimizes tha space that is to be utilized. As illustrated in FIG. 3, various unusual shapes have been positioned so as to interfit efficiently and make the optimum use of the available space.

Next, some communication or means of data transmission is necessary to transmit the final pattern of outlines 38 that has been arrived at to a computer-aided manufacturing (CAM) unit such as shown at 42. A data transmission line 43 is illustrated in FIG. 3; however, this is only illustrated for the sake of simplicity. It is to be understood that any means of data transmission could be used; for instance, the data from computer graphic unit 28 could be entered onto a computer disk that can be utilized with computer-aided manufacturing unit 42. CAM unit 42 consists of a robot arm 46 that moves a hot wire cutter 48 that is utilized to cut outlines 50 into Styrofoam TM sheet 23.

At this point in the manufacture, Styrofoam TM sheet 23 could have already been cut to the desired dimensions of the defined space, or it could be a large stock of Styrofoam TM. Normally, the sheet 23 would be preselected to have the desired final height of the tray 20. The sheet could be held by means of a clamp or a vacuum so that it does not move while being cut by hot wire 48. Hot wire 48 is moved both vertically and horizontally by computer-aided manufacturing unit 42 and arm 46 to cut the pattern 39 in Styrofoam TM sheet 23. As shown at 50, hot wire 48 is in progress cutting outline 50 and has already cut several outlines 52. It is to be understood that computer-aided manufacturing unit 42 would cut the outline such as shown at 52 and then be raised vertically upwardly to remove hot wire 48 from Styrofoam TM sheet 23. Arm 46 then rotates hot wire 48 to the position where it is desired to cut the next of the outlines. If a large stock of Styrofoam TM is used rather than a sheet that has already been cut to the desired dimensions, hot wire 48 can also cut the perimeter of the Styrofoam TM to arrive at the final shape of tray 20.

The next step is illustrated in FIG. 4 and consists of removing the cut-out parts or cores 52 from Styrofoam TM sheet 23. Some fastening means 53, such as Velcro TM, is attached to cut-out part 52 and used to secure the part to vacuum form machine 54. Vacuum form machine 54 is a commercially available item and consists of upper platen 56 and lower platen 58. Cut-out part 52 is attached to upper platen 56 in the same array or pattern 39 that would correspond to cut-out portions or cavities 62 on the sheet of Styrofoam TM 23. For simplicity, only one part 52 is illustrated. The upper platen 56, with the attached cores 52 is brought downwardly to ensure that the cores 52 are arranged in the proper pattern and that they correspond to the cavities 62. Once this is done, the platen 56 is raised back upwardly.

Thermoplastic sheet 24 is next heated to the point where it is malleable or, alternatively, a fluid-type of plastic is used. It is then placed over Styrofoam TM sheet 23 as it rests upon the lower platen 58 of vacuum form machine 54.

The upper platen is next brought downwardly with cores 52 until it contacts thermoplastic sheet 24 and forces it downwardly into cavities 62. A vacuum is applied to the lower platen to finish drawing the sheet 24 into the cavities 62. Upper platen 56 is then brought back upwardly along with cut-out parts 52 leaving plastic sheet 24 with receiving spaces 22 having been drawn therein. Plastic tray 20 remains as a unit on lower platen 58 with thermoplastic sheet 24 having been bonded to Styrofoam TM sheet 23.

If a thinner item is being stored, it is not necessary that the receiving spacess 22 be deep, and thus the use of the cut-out cores may not be necessary.

A specific embodiment of the present invention has been disclosed. However, it is to be understood that several variations of the disclosed steps could be envisioned as within the scope of this invention.

It is envisioned that the thermoplastic sheet may be mechanically attached rather than thermo-bonded to the structural foam sheet.

The intended scope of the present invention can be best understood when considered in light of the appended claims.

What is claimed is:

1. A plastic storage tray stored in a storage member, comprising:

a storage member having a specific width, length and height;

a sheet of structural foam having a relatively long width and length and a relatively short height, said sheet of structural foam having six faces;

a sheet of plastic bonded to said sheet of structural foam on at least one face thereof;

said sheet of structural foam having cavities of uniform height extending from said face that said plastic sheet which has been bonded to said sheet of structural foam to the opposite face;

said sheet of plastic having receiving compartments of uniform height formed therein that extend downwardly into said cavities in said sheet of structural foam;

said structural foam sheet and said plastic sheet comprising a plurality of said cavities and said receiving compartments respectively, of uniform height; and the shape of said cavities and said receiving compartments having been formed to correspond to the profiles of a series of items that a consumer wishes to store in said plastic storage tray, there being distinct shapes of said cavities;

said sheet height, width and depth of said sheet of structural foam having been selected to approximate said height, width and length of said storage compartment; and said plural cavities formed in said sheet of structural foam being arranged in a pattern, said pattern having been developed utilizing computer graphics to optimize the placement of the distinct shapes of said plural cavities.

* * * * *